US005637185A

United States Patent [19]

Murarka et al.

[11] Patent Number: 5,637,185

[45] Date of Patent: Jun. 10, 1997

[54] SYSTEMS FOR PERFORMING CHEMICAL MECHANICAL PLANARIZATION AND PROCESS FOR CONDUCTING SAME

[75] Inventors: Shyam P. Murarka, Clifton Park; Ronald J. Gutmann, Troy; David J. Duquette, Loudonville, all of N.Y.; Joseph M. Steigerwald, Aloha, Oreg.

[73] Assignee: Rensselaer Polytechnic Institute, Troy, N.Y.

[21] Appl. No.: 413,487

[22] Filed: Mar. 30, 1995

[51] Int. Cl.[6] ..... B24B 1/00; B24B 37/00

[52] U.S. Cl. ..... 438/5; 156/345; 216/86; 216/89; 438/693

[58] Field of Search ..... 156/636.1, 626.1, 156/627.1, 345; 216/88, 89, 86, 84; 451/287, 8

[56] References Cited

U.S. PATENT DOCUMENTS

| | | | |
|---|---|---|---|
| 5,196,353 | 3/1993 | Sandhu et al. | 437/8 |
| 5,217,586 | 6/1993 | Datta et al. | 204/224 M |
| 5,240,552 | 8/1993 | Yu et al. | 156/636.1 |
| 5,242,524 | 9/1993 | Leach et al. | 156/345 |
| 5,245,794 | 9/1993 | Salugsugan | 451/10 |
| 5,308,438 | 5/1994 | Cote et al. | 216/88 X |
| 5,492,594 | 2/1996 | Burke et al. | 216/88 X |

OTHER PUBLICATIONS

Steigerwald, et al.; *Electrochemical Effects in the Chemical–Mechanical Polishing of Copper and Titanium Thin Films Used for Multilevel Interconnect Schemes;* Jun. 1993 VMIC Conference, VMIC Catalog No. 931SMIC–102.

*Primary Examiner*—Thi Dang

*Attorney, Agent, or Firm*—Bell, Seltzer, Park & Gibson, P.A.

[57] ABSTRACT

A system for performing chemical mechanical planarization for a semiconductor wafer includes a chemical mechanical polishing system including a chemical mechanical polishing slurry. The system also includes a device for measuring the electrochemical potential of the slurry during processing which is electrically connected to the slurry, and a device for detecting the end point of the process, based upon the electrochemical potential of the slurry, which is responsive to the electrochemical potential measuring device. Accurate in situ control of a chemical mechanical polishing process is thereby provided.

27 Claims, 4 Drawing Sheets

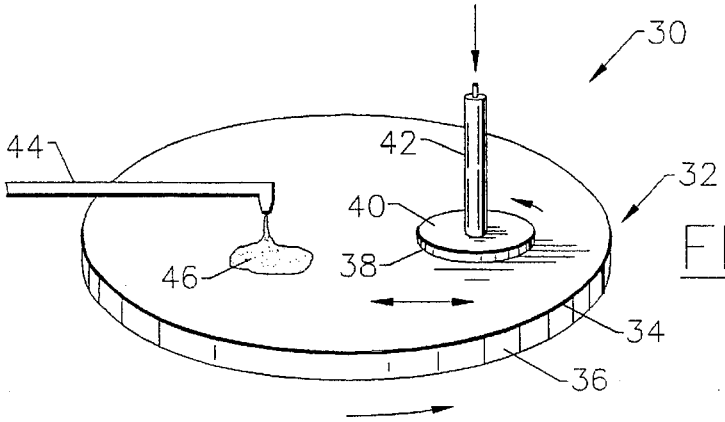
FIG. 2A.
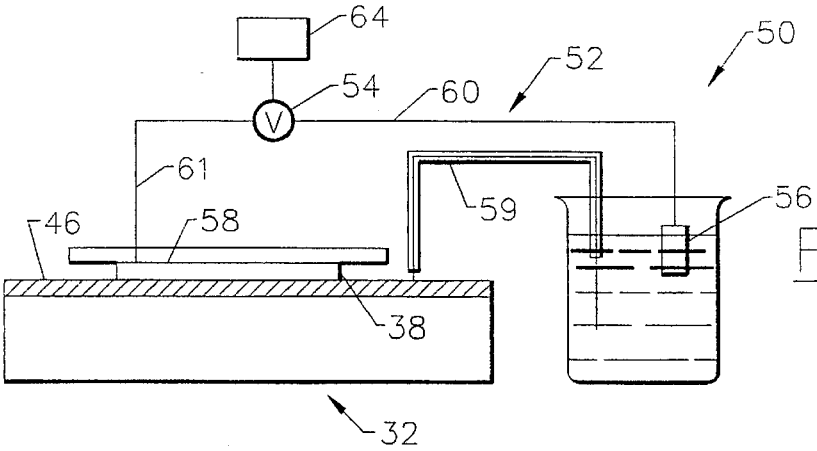
FIG. 3A.
FIG. 3B.
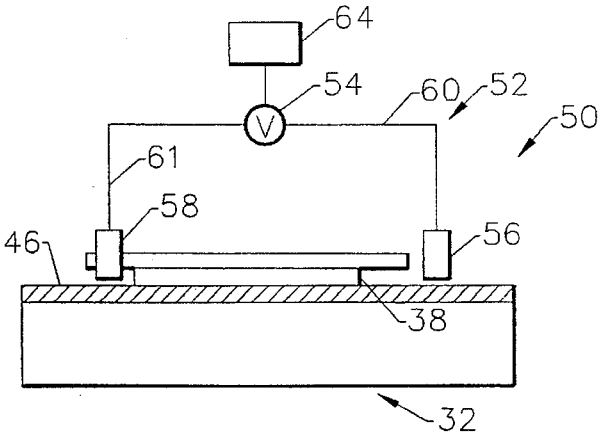

$NH_4OH$ $NH_4NO_3$ $NH_4Cl$

SYSTEMS FOR PERFORMING CHEMICAL MECHANICAL PLANARIZATION AND PROCESS FOR CONDUCTING SAME

FIELD OF THE INVENTION

This invention relates to semiconductor device manufacture, and more particularly to semiconductor device manufacture using chemical mechanical polishing processes.

BACKGROUND OF THE INVENTION

The wide spread use of integrated circuits (ICs), also referred to as "chips", in numerous applications is well known. Typically, in the manufacture of integrated circuits, a semiconductor wafer is formed having regions of insulating, conductive and semiconductive materials. For example, semiconductive regions or conductive metal regions can be formed in trenches of a silicon substrate.

As a result of the ever increasing number of uses for integrated circuits, manufacturing these devices has become increasingly competitive. Accordingly, the focus on development has been to increase chip performance while decreasing production cost.

Current trends in the integrated circuit industry include fabricating smaller devices having increased chip density. Reducing chip size can reduce chip manufacturing costs. In addition, devices having smaller dimensions can be advantageous because device delay can also be decreased, thereby increasing performance.

Device performance can also be increased by adding multiple levels of metallization. More particularly, the use of multiple levels of metal interconnections allows for wider interconnect layer dimensions with shorter interconnect lengths. Because such lengths have only been possible with single level devices, a corresponding decrease in interconnect delay has been achieved. Nonetheless, as many interconnect levels are added, topography that builds up with each level can become severe. Consequently, the reliability associated with fabricating a device including several thin layers can be sensitive.

To reduce the topography, interconnect levels are typically planarized. As known in the art, planarization may be described in three degrees including: (1) surface smoothing in which feature corners are smoothed and high aspect ratio holes are filled; (2) local-planarity whereby surfaces are flat locally but surface height varies across the die; and (3) global planarity where the surface is flat across the entire area.

As circuit dimensions are reduced, interconnect levels must be globally planarized to produce a reliable, high density device. Chemical mechanical polishing (CMP) is gaining rapid acceptance as the technique of choice for globally planarizing interlevel dielectric (ILD) layer surfaces and for delineating metal patterns in integrated circuits. F. B. Kaufman, et al., *J. Electrochem. Soc.* 138, 3460 (1991); C. W. Kaanta, et al., in *IEEE Proc. Multilevel Interconnect Conf.*, p. 144, (Santa Clara, Calif. June 1991).

In general, CMP processes involve holding or rotating a semiconductor wafer against a rotating wetted polishing surface under a controlled downward pressure. A chemical slurry containing a polishing agent, such as alumina or silica, is typically used as the abrasive medium. Additionally, the chemical slurry can contain chemical etchants for etching various surfaces of the wafer. In a typical fabrication of a device, CMP is first employed to globally planarize an ILD layer surface comprising only dielectric. Trenches and vias are subsequently formed and filled with metal by known deposition techniques. CMP is then typically used to delineate a metal pattern by removing excess metal from the ILD.

CMP is advantageous because it can be performed in one step, in contrast to past planarization techniques which are complex, involving multiple steps. Moreover, CMP has been demonstrated to maintain high material removal rates at high surface features and low removal rates at low features, thus allowing for uniform planarization. CMP can also be used to remove different layers of material and various surface defects. CMP thus can improve the quality and reliability of the ICs formed on the wafer.

A particular problem encountered during CMP processing, however, is the control of the various processing parameters to achieve the desired wafer characteristics. For example, in removing or planarizing a metal layer, it can be necessary to remove the metal to the top of the underlying layer without removing any portion thereof, i.e., overcut, yet also to achieve global planarization, i.e., avoid undercutting, as described above. Thus, to utilize CMP, an end point detector for the process is necessary.

Various techniques have been investigated for detecting the end point of CMP processes. For example, U.S. Pat. No. 5,217,586 to Datta et al. describes end point detection techniques involving coulometry or by tailoring the bath chemistry. U.S. Pat. No. 5,196,353 to Sandhu et al. describes end point detection using surface temperature measurements. U.S. Pat. No. 5,245,794 to Salugsugan describes an audio end point detector. U.S. Pat. No. 5,240,522 to Yu et al. describes an end point detector which detects reflected acoustic waves. U.S. Pat. No. 5,242,524 to Leach et al. describes an end point detector using impedance detection.

Despite these and other techniques for detecting the end point of a CMP process, it would be advantageous to provide an effective CMP system and process for globally planarizing and delineating layers in a semiconductor device, and particularly metal layers in multilevel semiconductor devices. It would further be advantageous to provide a CMP system and process having an effective end point detector to monitor and signal the end of the polishing process, i.e., when metal is completely removed from above an ILD surface, leaving metal only in the trenches and vias. In addition, it would be advantageous to provide a CMP system and process for detecting the end point during the CMP process, without having to remove the wafer from the system to determine if an end point has been reached.

SUMMARY OF THE INVENTION

The present invention provides a system and process for monitoring chemical mechanical polishing processes, and in particular for detecting the end point of such a process. The chemical mechanical polishing system of the invention includes electrochemical potential measuring means which is electrically connected to a polishing slurry. The electrochemical potential measuring means measures the electrochemical potential of the slurry during chemical mechanical polishing, thus monitoring the progress of the process.

Specifically, electrochemical potential measuring means includes a reference electrode which is electrically connected to the chemical mechanical polishing slurry during planarization. Before the process is begun, the reference electrode is initially used to obtain a reference or baseline electrochemical potential measurement of the slurry prior to entering the system.

Electrochemical potential measuring means also includes a measurement electrode positioned in the polishing slurry adjacent the wafer being polished. During processing, the reference electrode is connected to the measurement electrode to provide a closed circuit. The measurement electrode thus can measure the electrochemical potential of the slurry in a region proximate the wafer during polishing. This measurement is made relative to the reference electrochemical potential measurement provided by the reference electrode.

The measurement electrode and the reference electrode can be any of the types of materials known in the art for measuring the electrochemical potential of an aqueous system. For example, the measurement electrode can be the surface of the layer which is being polished. In another embodiment of the invention, the measurement electrode is a probe positioned in the chemical mechanical polishing slurry in close proximity to the semiconductor wafer being polished.

The reference electrode can be any of the types of reference electrodes known in the art, such as saturated calomel electrodes (SCE), standard hydrogen electrodes (SHE), and the like. The reference electrode can be electrically connected to the slurry by directly contacting the electrode to the slurry. Alternatively, the reference electrode can be electrically connected to the slurry through an electrolytic conductor, such as a salt bridge.

The chemical mechanical polishing system of the invention also includes end point detection means, responsive to the electrochemical potential measuring means. End point detection means detects an end point of the chemical mechanical polishing based upon the electrochemical potential of the slurry. The end point detection means can be, for example, a voltmeter connecting the reference electrode and the measurement electrode. The voltmeter records changes in the electrochemical potential of the slurry during processing as measured by the measurement electrode relative to the reference electrochemical potential measurement of the slurry prior to entering the system.

The invention also provides a process for performing chemical mechanical planarization for a semiconductor wafer. The process of the invention includes chemically and mechanically planarizing the surface of a semiconductor wafer using a chemical mechanical polishing (CMP) system which includes a chemical mechanical polishing slurry.

To determine when the end point of the process is reached, the electrochemical potential of the slurry is measured during the planarizing step. In particular, the electrochemical potential of the slurry in a region proximate the wafer during polishing is measured and compared with a reference or baseline electrochemical potential measurement of the slurry prior to entering the system.

The process is then controlled in response to the measured electrochemical potential of the slurry during planarization. The controlling step detects an end point to the planarizing step by detecting changes in the measured electrochemical potential of the slurry in a region proximate the wafer relative to the reference electrochemical potential measurement. For example, an end point can be detected when a change in the electrochemical potential of the slurry indicates that abraded material from the surface of the layer being planarized has been removed. Also, an end point can be determined when a change in the electrochemical potential of the slurry indicates that an underlying metal layer has been reached.

Thus the system and the process of the invention provide for accurate determination of an end point of a chemical mechanical polishing process. The end point can be determined without having to physically remove and inspect the polished wafer; rather, the process of the invention can be conducted in situ, thus eliminating time consuming steps. The end point can also be detected accurately, and thus overpolishing or underpolishing can be avoided.

In addition, layers in semiconductor devices can be globally planarized using the system and process of the present invention. This is particularly advantageous in the production of devices with submicron feature sizes and complex multilevel metallization schemes. This in turn results in more accurate devices and lower defect ratios.

BRIEF DESCRIPTION OF THE DRAWINGS

Some of the features and advantages of the invention having been stated, others will become apparent from the detailed description which follows, and the accompanying drawings in which:

FIG. 2 is a perspective view of a chemical mechanical polishing tool which can be used in accordance with the invention;

FIGS. 3A and 3B are schematic cross sectional views of a system of the present invention for performing chemical mechanical planarization for a semiconductor wafer;

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that the disclosure will be thorough and complete, and will fully convey the scope of the invention to those skilled in the art. Like numbers refer to like elements throughout. For purposes of clarity the scale has been exaggerated.

FIGS. 1A, 1B, 1C and 1D are side cross-sectional views of a multilevel semiconductor device, designated generally as 10, in progressive stages of manufacture. Semiconductor device 10 can be, for example, a wafer for use in VLSI (very large scale integrated) circuits, ULSI (ultra large scale integrated) circuits, and the like. Such wafers are known in the art.

Figure 1A:
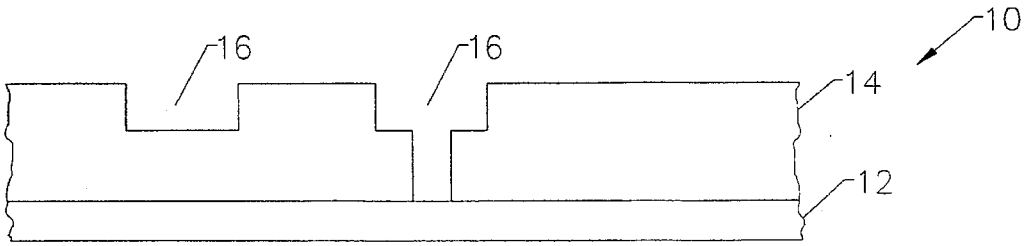
FIGS. 1A, 1B, 1C and 1D are side cross-sectional views of a multilevel semiconductor device in progressive stages of manufacture.
Figure 1B:
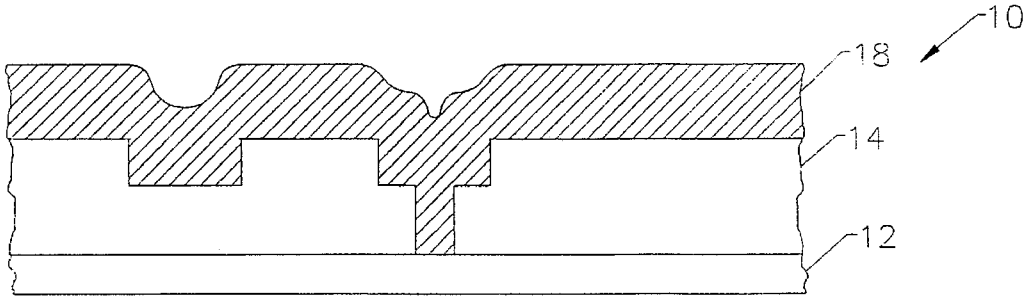

In FIG. 1A a semiconductor substrate 12 provides support for subsequent layers of the semiconductor device 10. Substrate 12 can be formed of any suitable material known to the skilled artisan, such as silicon (Si). An insulating layer 14, such as layer of silicon dioxide ($SiO_2$), is formed on substrate 12 and includes trenches 16 etched therein. As indicated in FIG. 1B, layer 18, here a conducting metal layer, is deposited onto the surface of insulating layer 14 and in trenches 16.

Metal layer 18 is formed using any of the techniques known in the art for depositing such layers, such as physical vapor deposition, chemical vapor deposition, and the like. Metal layer 18 comprises any of the conductive materials used in the art to fabricate a conductive layer in a semiconductor device. Exemplary materials include but are not limited to metals such as copper, aluminum, titanium, gold, silver, tungsten, and the like, as well as alloys and mixtures of these and other metals. Preferably, metal layer 18 is a copper layer.

Metal layer 18 can be deposited along with any required liner films acting as adhesive layers, diffusion barriers, etc. An exemplary liner material is titanium, which is particularly useful with copper conductive layers. Deposition techniques and apparatus used to form liner layers, and material used as liner layers, are all conventional.

Figure 1C:
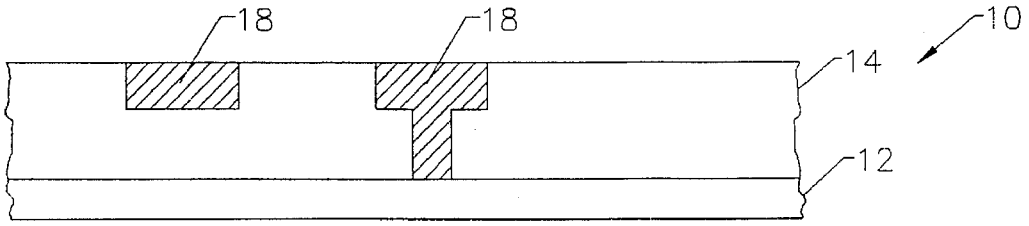

To manufacture a device exhibiting improved performance, residual metal bordering trenches 16 is removed to leave metal only in the trenches. In addition, metal layer 18 is globally planarized. FIG. 1C illustrates semiconductor device 10 after residual metal has been removed and metal layer 18 has been planarized, for example, using the CMP system and process of the present invention. The surface is planar and the trenches are filled with metal.

Figure 1D:
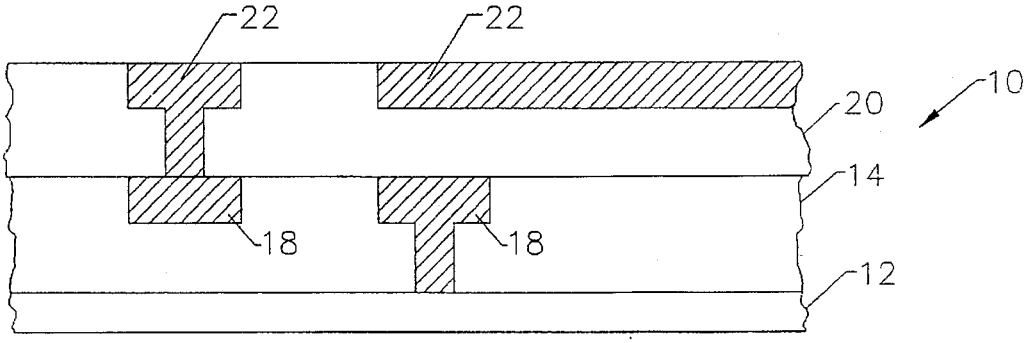

FIG. 1D further illustrates the deposition and planarization of additional insulating layer 20 and conducting layer 22 to form multilayer semiconductor device 10.

To use chemical mechanical polishing to polish or planarize layers in semiconductor devices, a system is needed which can monitor the parameters of the process so as to determine when a predetermined end point is reached. The end point of the CMP process is detected in the present invention by measuring the electrochemical potential of the polishing slurry, as described in more detail below.

Commercially available CMP systems can be used in the present invention, and include, for example a 6CU polisher manufactured by R. H. Strasbaugh; a Westech polisher manufactured by Westech Engineering; and the like. An exemplary CMP system 30 is illustrated in FIG. 2.

As illustrated in FIG. 2, CMP systems typically include a rotatable polishing table 32, which comprises a polish pad or surface 34 mounted on a rotatable polishing platen 36. Typically the polishing pad is a relatively soft material such as blown polyurethane. Alternatively, the polishing pad can be a relatively rigid material. The polishing table 32 is mounted for rotation by a drive motor (not shown).

A wafer 38 having a surface which is to be polished is mounted on a rotatable wafer carrier 40. The wafer 38 and wafer carrier 40 are attached to a vertical drive arm 42 driven also by a suitable drive motor (not shown) for moving the carrier in both rotation and oscillating directions as shown by the arrows. Preferably the wafer carrier is rotated in the same direction as the polishing table. The vertical arm 42 also vertically positions the wafer carrier 40 to bring the wafer 38 into contact with the underlying polish pad 34 and maintains the desired downwardly directed polishing contact pressure.

The polishing platen 36 is relatively large compared to the size of the wafer so that during CMP processing the wafer can be moved across the surface of the polishing pad 34 by wafer carrier 40.

A slurry tube 44 positioned above the polishing pad 34 dispenses and evenly saturates the polishing pad 34 with a slurry 46. The slurry includes an abrasive material, such as alumina or silica particles, in an aqueous carrier, for mechanical interaction at the surface of the wafer in a carrier. The slurry can also include chemical agents which chemically interact with the surface being polished.

The composition of the slurry is selected to provide an abrasive medium and chemical activity for the etching. A variety of polishing compositions are known in the art and can be selected for use in the present invention according to the desired manufacturing parameters, such as the nature of the material being polished, the desired rate of polishing, and the like. Illustrative slurry compositions particularly useful for chemical mechanical polishing of copper layers are described in more detail in the quantitative description of the invention below.

Chemical mechanical polishing takes place by rotating the polishing table 32 and the wafer carrier 40, so as to cause a chemical mechanical polishing action to remove the upper surface of the wafer layer. During chemical mechanical polishing, centrifugal forces act to distribute the slurry across the polishing pad to form a thin sheet of slurry on the polishing surface. The combination of mechanical action from the force and velocity applied to the abrasive particles and the chemical action from the wafer and chemical reagents results in removal of material from the surface of the wafer.

The selection of controlled pressure of the wafer against the polishing pad, time, temperature, the composition and flow rate of the slurry, as well as other factors, are dependent upon the material being polished and the desired end result. The selection of these parameters in within the knowledge of the skilled artisan.

Referring now to FIGS. 3A and 3B, schematic cross sectional views of illustrative embodiments of the CMP system of the present invention are illustrated. The CMP system of the present invention is designated generally as 50 in each of FIGS. 3A and 3B. Each of the embodiments of CMP system 50 of the present invention performs chemical mechanical planarization for a semiconductor wafer and includes the basic features described above, i.e., a polishing table 32 and a chemical mechanical polishing slurry 46 for polishing the surface of a wafer 38.

In addition, the chemical mechanical polishing system of the present invention includes means for measuring the electrochemical potential of the polishing slurry during processing, designated generally as 52. Electrochemical potential measuring means 52 is electrically connected to polishing slurry 46. The chemical mechanical polishing system of the invention also includes end point detection means, designated as 54 in FIGS. 3A and 3B. End point detection means is responsive to electrochemical potential measuring means 52, i.e., end point detection means 54 detects an end point of the chemical mechanical polishing based upon the measured electrochemical potential of the slurry. End point detection means 54 can be, for example, a voltmeter.

Specifically, the electrochemical potential of the slurry is measured during processing at a region proximate the wafer being polished. This measurement is made relative to a baseline or reference electrochemical potential measurement of the slurry prior to entering the system. Prior to planarization, a reference electrode, designated as 56 in FIGS. 3A and 3B, is used to obtain the reference electrochemical potential measurement of the slurry. For example, the electrochemical potential of a bulk solution of the slurry can be measured with reference electrode 56 prior to conducting the CMP process of the invention. The resultant electrochemical potential measurement of the bulk solution provides a baseline or reference electrochemical potential measurement, against which changes in the potential of the slurry can be monitored during processing, as explained below.

Electrochemical potential measuring means 52 also includes a measurement electrode, designated generally as 58 in FIGS. 3A and 3B. Measurement electrode 58 is located in the slurry of the system adjacent the wafer being polished. During processing, reference electrode 56 is electrically connected with slurry 46 and with measurement electrode 58 to provide a closed circuit. Measurement electrode 58 thus measures the electrochemical potential of the slurry in a region proximate the wafer during polishing. This measurement is made relative to the reference electrochemical potential measurement provided by reference electrode 56.

Any of the types of devices used to measure electrochemical potential of a system can be used in accordance with the present invention. Exemplary electrochemical potential measuring means are illustrated in FIGS. 3A and 3B.

Referring first to FIG. 3A, reference electrode 56 can be any of the types of reference electrodes known in the art, such as saturated calomel electrodes (SCE), standard hydrogen electrodes (SHE), and the like. Reference electrode 56 as illustrated in FIG. 3A can be electrically connected to the slurry through an electrolytic conductor 59, such as a salt bridge, a saturated cotton string, and the like. Alternatively, as illustrated in FIG. 3B, reference electrode 56 can be electrically connected to the slurry by direct contact with the slurry in a region distal to the wafer being polished. Electrode 56 is also connected to voltmeter 54, by wire 60.

Referring back to FIG. 3A, measurement electrode 58 can be a surface of a metal film on a wafer which is being polished. The surface of the metal film is connected to voltmeter 54 by wire 61. In one aspect of this embodiment of the invention, the surface of the film which is directly contacting the slurry, i.e., the surface of the film which is being polished, is connected to voltmeter 54.

Alternatively, the film to be polished can be deposited onto a supporting substrate so that the film is a continuous film extending from one side of the substrate to the opposing side of the substrate. In this aspect of the invention, illustrated in FIG. 3A, the surface of the film opposite the surface of the film in direct contact with the slurry, i.e., opposite the surface of the film being polished, is connected to the voltmeter.

As illustrated in FIG. 3B, measurement electrode 58 can also be a probe of the type known in the art for measuring electrochemical potentials of a system. For example, the probe can be a metal probe or plate, i.e., a titanium probe or plate, placed on the surface of polishing pad 34 in a region of the slurry proximate to the metal layer being polished. The probe is also connected to voltmeter 54 by wire 61.

The electrochemical potential of the slurry during processing will differ over time within localized regions of the slurry. For example, there are several interactions which can take place in the slurry in the region adjacent the wafer which affect the electrochemical potential thereof. The mechanical action of abrasive particles in the slurry abrades and removes material from the surface of the wafer being polished. Further, chemical reagents in the slurry can dissolve the abraded material to remove the abraded materials from the surface of the wafer. The chemical reagents can also chemically react with the surface of the film being polished to remove material chemically.

As a result of these and other interactions at the surface of the wafer being polished, the composition of the slurry in the region proximate the wafer changes during polishing. For example, when polishing a copper layer, the concentration of copper ions and other copper compounds in the slurry will change during polishing, initially increasing, and then decreasing as the copper material is removed and the underlying surface is reached.

As explained quantitatively below, changes in the concentrations of materials in the slurry during processing can be determined by monitoring changes in the electrochemical potential of the slurry during CMP. For example, changes in the electrochemical potential of the slurry in the region adjacent the wafer can initially reflect an increase in the concentration of the abraded material and eventually a decrease in the concentration of the abraded material as the layer is removed. Changes in the electrochemical potential of the slurry can also reflect that a layer has been removed and an underlying layer, such as a metal liner layer, has been reached. These changes in the measured electrochemical potential of the slurry during processing signal the end point of the process.

The end point is determined by end point detection means 54. End point detection means 54 monitors the changes in the electrochemical potential of the slurry proximate the wafer relative to the baseline reference electrochemical potential of the slurry prior to entering the system. As noted above, end point detection means 54 can be, for example, a voltmeter connecting reference electrode 58 and measurement electrode 56.

As explained above, during polishing, the electrochemical potential of the slurry near the wafer changes. The potential initially reflects an increase in the concentration of abraded material in the slurry. This value decreases suddenly as the polishing process is completed and the abraded material is removed from the region. This value can also change if an underlying layer, such as a metal liner layer, is reached.

Thus an end point of the process, i.e., when essentially all of the layer being polished is removed, can be detected when the change in the electrochemical potential of the slurry proximate the wafer as measured by measurement electrode 56 reflects the absence of the abraded material. The electrochemical potential change can also reflect the addition of different ions in solution, if, for example, an underlying metal layer is reached. Thus end point detector means 54 indicates that substantially all of a particular material has been removed from the surface of the substrate, or that a layer comprising a different material has been reached, and accordingly, that the end point of the process is reached.

CMP system 50 can also include control means 64 for receiving and analyzing data received from end point detector means 54. Control means 64 is capable of generating signals for controlling the operation parameters of the system in response to the data received. Accordingly, when a predetermined electrochemical potential reading is received by control means 64, indicating that a desired end point is reached, control means 64 can then be programmed to stop the CMP process.

Figure 4:
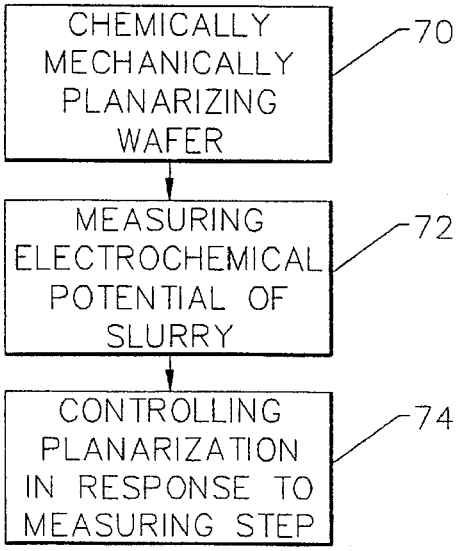
FIG. 4 is a flow chart illustrating a process for performing chemical mechanical planarization for a semiconductor wafer in accordance with the present invention.

The present invention also provides a process for performing chemical mechanical planarization for a semiconductor wafer. FIG. 4 is a flow chart representing an illustrative process in accordance with the invention. As indicated at Block 70, the process includes processing a semiconductor wafer by chemically and mechanically planarizing the surface thereof using a chemical mechanical polishing system. During planarization, the electrochemical potential of the slurry is measured, as indicated in Block 72. Preferably, the electrochemical potential of the slurry is measured by measuring the electrochemical potential of the slurry in a region proximate the wafer during polishing relative to a reference electrochemical potential measurement of the slurry established prior to the process.

Changes in the measured electrochemical potential slurry during processing indicate the stage of the CMP process, as material is abraded from the surface of a layer being polished, and as the concentrations of abraded material in the slurry change. Block 74 indicates that the planarizing step is controlled in response to the measuring step, and specifically to a predetermined change in the potential of the slurry. This change indicates that the process is complete.

Ouantitative Description

A description of the present invention for a particular set of parameters (chemical mechanical polishing of a copper film) will now be provided. As will be appreciated by the skilled artisan, a much wider range of film materials and process conditions (i.e., pressure, rotational velocities, slurry compositions, slurry delivery and flow rates, etc.) can also be used in accordance with the present invention. Any of the types of materials which are capable of being chemically and mechanically polished and which undergo oxidation/reduction reactions during CMP processing, thus providing an electrochemical potential in solution which can be measured, can be used.

CMP is particularly attractive for manufacturing interlevel devices which include copper as conductive layers. Traditional metal pattern delineation techniques such as reactive ion etching processes (RIE) require volatile metallic compounds be formed at appropriate processing temperatures. While RIE can be used for aluminum and aluminum alloys, necessary volatile copper compounds are scarce at temperatures at which RIE is commonly employed. B. J. Howard and Ch. Steinbruchel, *Appl. Phys. Lett.* 59, 914 (1991).

The electrochemical potential is a measure of the driving force (or free energy change) of the oxidation/reduction reactions that occur during metal dissolution. For example, copper dissolution may occur by the reduction-oxidation reaction:

$$Cu^{2+}2e^{-} \leftrightarrows Cu \tag{1}$$

The reversible potential for this reaction is given by:

$$\epsilon_{Cu^{2+}/Cu} \leftrightarrows \epsilon^{\circ} + 13 \cdot 1n[Cu^{2+}]\ [m\text{Volts}] \tag{2}$$

where $\epsilon^{\circ}$ for Reaction (1) is 337 mV vs the standard hydrogen electrode (SHE) (H. H. Uhlig, *Corrosion and Corrosion Control,* John Wiley & Sons Inc., New York, (1985)) and $[Cu^{2+}]$ indicates copper ion activity.

Figure 5:
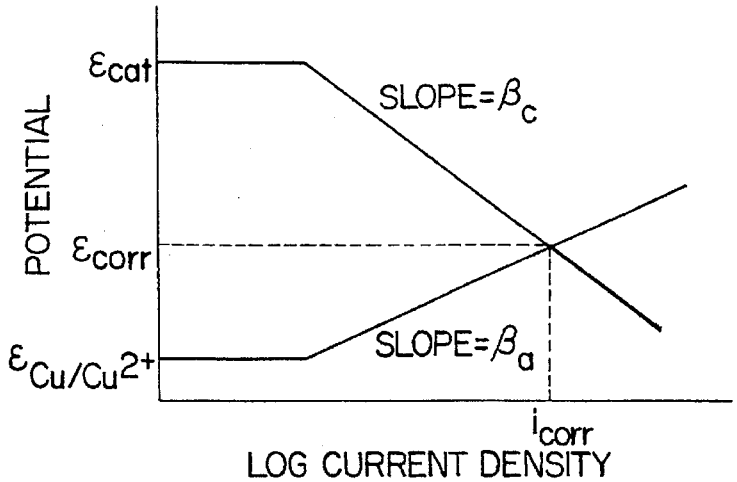
FIG. 5 is a schematic representation of the equilibrium between $Cu/Cu^{2+}$ reaction and hypothetical reduction reaction and illustrates that the mixed corrosion potential, $\epsilon_{corr}$, and the dissolution current density, $i_{corr}$, occur at the intersection of the cathodic reduction curve and the anodic oxidation curve.

For simplicity, all ion activities are assumed to be equal to the molar ion concentration. Thus, a measurement of the reversible potential would provide a direct measure of the copper ion concentration. However, the reversible potential can be difficult to measure directly. Instead, the mixed corrosion potential, $\epsilon_{corr}$, as illustrated in FIG. 5, can be measured. FIG. 5 is a schematic representation of the equilibrium between $Cu/Cu^{2+}$ reaction and hypothetical reduction reaction. The mixed corrosion potential, $\epsilon_{corr}$ and the dissolution current density, $i_{corr}$, occur at the intersection of the cathodic reduction curve and the anodic oxidation curve. The dissolution current density, $i_{corr}$, is the rate at which the reactions proceed. The mixed potential is dependent upon several factors including $\epsilon_{cat}$ (the reversible potential of the cathodic reaction), $\epsilon_{Cu^{2+}/Cu}$, the Tafel slopes $\beta_a$ and $\beta_c$ of each reaction, and whether the reactions are controlled by Tafel kinetics or concentration polarization. In addition, other copper oxidation reactions may occur simultaneously which will influence the mixed potential.

Because the mixed potential involves unknown variables, the concentration of copper ions in the slurry is not easily calculated directly from a measurement of the mixed potential. However, relative changes in ion concentration can be inferred from changes in the mixed potential.

From FIG. 5, as the concentration of $Cu^{2+}$ increases and $\epsilon_{Cu^{2+}/Cu}$ shifts in the noble (positive) direction, the mixed potential, $\epsilon_{corr}$, increases. Thus, if it is assumed that any increase in $e_{corr}$ is due only to an increase in $[Cu^{2+}]$, the change in $[Cu^{2+}]$ from a change in $\epsilon_{corr}$ can be approximated. Specifically:

$$\Delta\epsilon_{corr} \alpha \Delta\epsilon_{Cu^{2+}/Cu} = 13 \cdot \ln \frac{[Cu^{2+}]_{final}}{[Cu^{2+}]_{init}} \tag{3}$$

Figure 6:
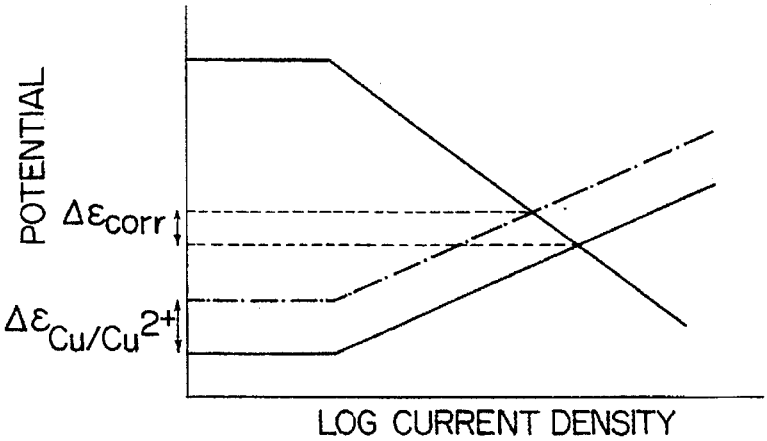
FIG. 6 is a schematic representation of the relationship between $\epsilon_{corr}$ and $[Cu^{2+}]$ and illustrates that increasing $[Cu^{2+}]$ increases the reversible potential for copper dissolution, $\epsilon_{Cu/Cu2+}$, and shifts the $Cu/Cu^{2+}$ oxidation curve, and hence the intersection with the reduction reaction, in the noble direction; and FIGS. *7a*, *7b* and *7c* are potential traces for copper polished in (a) 1.0 vol % $NH_4OH$; (b) 1.4 wt % $NH_4NO_3$; and (c) 0.94 wt % $NH_4Cl$ slurries, respectively.
Figure 7A:
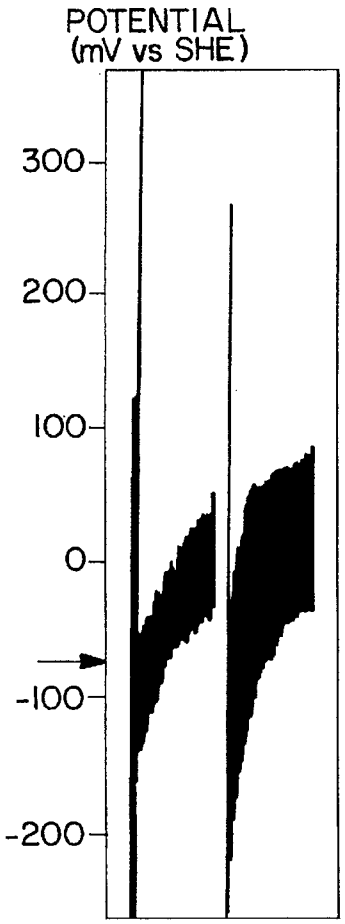
Figure 7B:
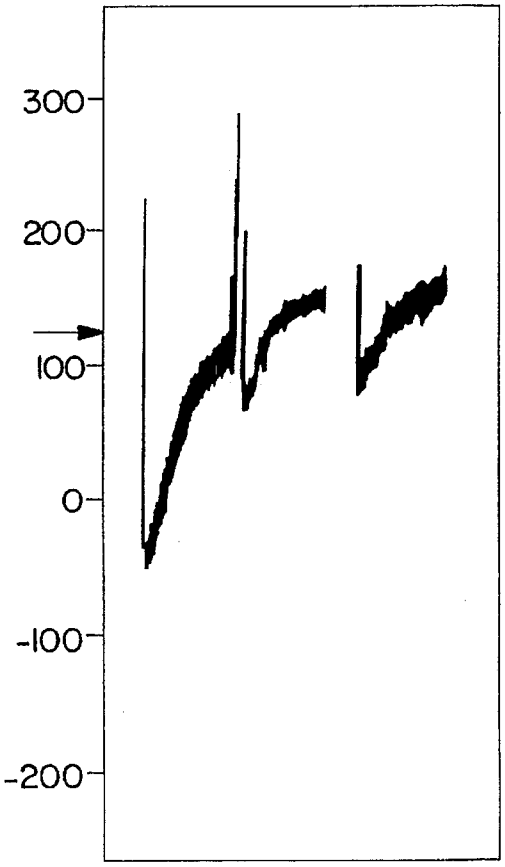
Figure 7C:
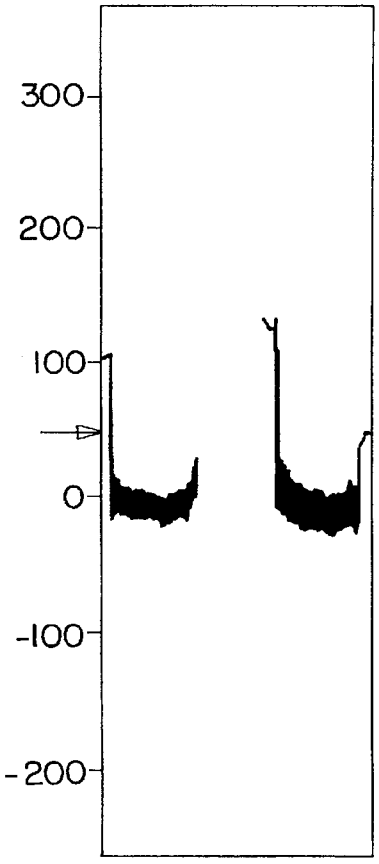

FIG. 6 is a schematic representation of the relationship between $\epsilon_{corr}$ and $[Cu^{2+}]$ and illustrates Equation 3. FIG. 6 illustrates that increasing $[Cu^{2+}]$ increases the reversible potential for copper dissolution, $\epsilon_{Cu/Cu^{2+}}$, and shifts the $Cu/Cu^{2+}$ oxidation curve, and hence the intersection with the reduction reaction, in the noble direction. Therefore, an increase in $[Cu^{2+}]$ increases the mixed corrosion potential $\epsilon_{corr}$. In general, copper may dissolve as ions other than $Cu^{2+}$ and therefore, $\Delta\epsilon_{corr}$ represents the increase in the concentration of all ionic copper species.

Experimental Arrangement

Substrates used for polishing were 75 mm and 125 mm silicon wafers. The wafers were first cleaned using a standard RCA clean, W. Kern and D. A. Poutinen, *RCA Review,* page 187, June 1970. After cleaning, $SiO_2$ was either thermally grown in a dry $O_2$ ambient to a thickness of 60–200 nm, or deposited by plasma enhanced chemical vapor deposition (PECVD) from a tetraethyl orthosilicate (TEOS) gas source to a thickness of 1.0 to 2.0 μm. A thin metal liner film (20–100 nm) was sputter deposited using a DC magnetron sputter tool followed by a 1.0 to 2.0 μm thick copper film without breaking vacuum between film depositions. The liner film was either titanium, titanium nitride (TIN) or tantalum.

Both annealed and unannealed copper films were polished. Two anneal cycles used were (1) a 300° C., 1 hour anneal at a pressure of less than $10^{-7}$ Torr and (2) a 400° C., 10 minute anneal at a base pressure of less than $10^{-4}$ Torr in an 8 mTorr argon ambient. $Cu_2O$ films were prepared by oxidizing annealed copper films in an oxygen ambient at a pressure of 1 atm and a temperature of 250° C. for 2.5 hours.

A 6CU polisher manufactured by R. H. Strasbaugh was used to polish the wafers, using Suba™ IV and Suba™ polishing pads. The wafer was rotated with the same rotational velocity as the pad, thus maintaining a constant average linear velocity across the wafer. For electrochemical potential measurements, the rotational velocity was 50 rpm (110 cm/sec), and the applied load was 67N (15 pounds) across a template plus wafer area of 226 $ccm^2$, giving a pressure of 3.0 kPa (0.4 psi).

The slurry included 2.5 or 5.0 weight % commercially available $\alpha$-$Al_2O_3$ abrasive specified to have 300 nm average aggregate particle size, deionized (DI) water, and chemical reagents. Different sized alumina abrasive were used including a specified 3.0 μm average aggregate particle size and a colloidal suspension of alumina with a mean particle size of 94 cm. Various chemical agents which can be used in processing copper are listed in Table 1 below. Concentrations given in vol % refer to the percent by volume of the chemicals listed in Table 1. 1.0 vol % $NH_4OH$ contained 0.3% wt % $NH_2$.

TABLE 1

| Chemical | Formula | Conc. or Form |
|---|---|---|
| Acetic Acid | $CH_3COOH$ | .99 Wt % |
| Ammonium Chloride | $NH_4Cl$ | Solid |
| Ammonium Hydroxide | $NH_4OH$ | 30 wt % $NH_3$ |
| Ammonium Nitrate | $NH_4NO_3$ | Solid |
| Benzotriazoie | $C_6H_5N_3$ | Solid |
| Copper (II) Nitrate | $Cu(NO_3)_2$ | Solid |
| Ethyl Alcohol | $CH_3CH_2OH$ | 100% |
| Nitric Acid | $HNO_3$ | 70 wt % |
| Potassium Ferricyanide | $K_3Fe(CN)_6$ | Solid |
| Potassium Ferrocyanide | $K_4Fe(CN)_6$ | Sohd |

It is noted that the components of the slurry can be selected according to the desired processing conditions. For example, the slurry reagents should dissolve the material mechanically abraded from the surface. The chemical agents can also react with the abraded material to form a surface film that acts as a boundary layer between the surface and the slurry to prevent dissolution of the surface in the absence of mechanical abrasion. This can lower the removal rate of the material in recessed regions (the low areas not contacting the polishing pad) to provide planarization of uneven surfaces. In addition, it is advantageous that the slurry chemicals accelerate the dissolution of the abraded material.

For example, for the CMP of copper, oxidizing agents such as ferricyanide ions ($Fe(CN)_6^{-1}$) and nitrate ions ($NO_3^-$) can be added to the slurry to drive the reaction forward and to increase dissolution of copper. Thus the addition of agents to drive forward the dissolution of the abraded material can be an effective means for increasing the polish rate. In addition, for copper, dissolved $NH_3(g)$ in the slurry can complex the copper ions and thus increase copper solubility.

The slurry was delivered to the pad during polishing by one of two techniques. In one technique, the slurry abrasive was mixed with DI water in a separate reservoir from the chemicals. The abrasive/water mixture was stirred during use to insure homogeneity of the mixture and deagglomeration of the solids. The chemicals were then mixed the abrasive/water mixture during use and delivered to the center of the pad at a rate of 250 ml/minute.

Alternatively, the slurry abrasive and the chemicals were mixed with DI water in a bottle before polishing. The slurry was delivered directly to the pad from the bottle after being shaken to insure homogeneity of the mixture and deagglomeration of the solids. Approximately 150 ml of slurry was delivered to the pad before polishing began and 250 ml/min were delivered during polishing.

Two processes were used to obtain the mixed potential of the slurry-metal system. For both processes, the potential was referenced to a reference electrode 56, such as a saturated calomel electrode (SCE) with $\epsilon_{ref}$=240 mV versus the standard hydrogen electrode ($V_{SHE}$). The reference electrode 56 is electrically connected to the slurry 46 by either direct contact therewith (FIG. 3B) or through the use of an electrolytic conductor 59 (FIG. 3A) such as a salt bridge or a saturated cotton string. The reference electrode 56 is contacted to the measurement electrode 58 through a voltmeter 54 which measures the mixed potential of slurry 46.

The two processes also differ in the measurement electrode 58, which can be a metal film 38 being polished (FIG. 3A). Because the slurry is resistive and because the concentration of dissolved $O_2$ in the slurry directly under the wafer is decreased by the polishing action, the potential at the location of the metal film can be different than the potential elsewhere in the slurry. Thus, using the metal film as the measurement electrode is most useful when using a Pourbaix diagram to determine the stability of the metal film. When using this embodiment of the invention, advantageously, both sides of the substrate is metallized so that the film is continuous around to the back of the substrate. Contact to the metal film on the front side of the substrate may then be made by contacting the back side thereof.

The measurement electrode 58 can also be a probe, such as a platinum wire or plate, placed in the slurry 46 in close proximity to the metal film being polished (FIG. 3B). By placing the electrode in close proximity to the metal film being polished, the resistance between the film and the electrode is minimized, minimizing the error.

FIGS. *7a*, *7b* and *7c* are potential traces for 75 mm diameter copper coated wafers polished in (a) 1.0 vol % $NH_4OH$; (b) 1.4 wt % $NH_4NO_3$; and (c) 0.94 wt % $NH_4Cl$ slurries, respectively. While the traces for the $NH_4OH$ slurry and the $NH_4NO_3$ slurries both increased during polishing, the trace for the $NH_4Cl$ slurry was nearly flat. This indicates that the potential for the $NH_4OH$ and $NH_4NO_3$ slurries increased during polishing while the potential of the $NH_4Cl$ slurry remained constant. Also, for the $NH_4OH$ and $NH_4NO_3$ slurries, the trace slope of the trace decreased as the polishing proceeded, i.e., the slope of the potentials decreased.

FIGS. *7a*, *7b*, and *7c* also indicate that once polishing began, the potential drops instantaneously as dissolved $O_2$ in the slurry is consumed to provide the cathodic reaction for copper dissolution. As the concentration of $O_2$ decreases, $\epsilon_{cat}$ decreases and the $O_2$ cathodic curve moves in the active (negative) direction causing the mixed potential to decrease.

For $NH_4OH$ and $NH_4NO_3$ slurries, after the initial decrease, the potential rises steadily during the polish as copper ions build up in the slurry. The average and one standard deviation of the polishing potentials were measured for each of the slurries of FIGS. *7a*, *7b*, and *7c* (data not shown). The greatest change in potential was seen for the $NH_4OH$ slurry suggesting that the most dissolution occurs in $NH_4OH$. In contrast, the change in potential for the $NH_4Cl$ slurry was nearly zero, suggesting a very low rate of dissolution. On this basis, the polish rate is expected to be highest in $NH_4OH$ and lowest in $NH_4Cl$.

For $NH_4OH$ and $NH_4NO_3$ slurries, the slope of the potential trace decreased as the polish proceeded. The potential is proportional to the logarithm of concentration. Consequently, for a constant rate of change in copper ion concentration, the potential will increase faster at the beginning of the polish when the copper ion concentration in the slurry is low than at the end of the polish when the copper ion concentration is high.

The average polish rate and one standard deviation for each of the slurries was also measured. As expected, the polish rate was highest for $NH_4OH$ and lowest for $NH_4Cl$.

In addition, the polish rate increased linearly with the change in potential (data not shown). Because the rate of the change in potential is proportional to the dissolution rate (Equation 3), the polish rate must also be proportional to the dissolution rate, thereby demonstrating the importance of dissolution in the CMP process.

This example shows that the potential measurement may be used to monitor the progress of the polish and predict the polish rate, which makes this invention useful as an in situ process monitor. In this example copper metal was used. However, this process should be useful for any metal that may be patterned using CMP.

A second use of this invention as a process monitor is in the detection of the process endpoint. Endpoint occurs when all of the metal is removed from above the ILD and remains only in the trenches and vias. Because the metal film being polished cannot be viewed during polishing, endpoint is difficult to detect. However, often metal films, such as copper, require an underlying metal film, such as titanium, as either an adhesion promoter or diffusion barrier. In such instances, this invention can be used to detect when the underlying film is exposed to the slurry, thus signaling endpoint.

As an example of how endpoint is detected using potential measurements, the polishing of copper with an underlayer of titanium is examined. During copper polishing in a $NH_4OH$ based slurry, the mixed potential rises from $-110\ mV_{SHE}$ to $-20\ mV_{SHE}$. However, for titanium polishing in the same slurry after the polishing of copper, the potential measured is $-230\ mV_{SHE}$. The potential decreases with titanium metal in the slurry because titanium is a more active metal than copper. This change in potential may be detected by monitoring the potential during polishing and indicating the process endpoint.

The foregoing examples are illustrative of the present invention, and are not to be construed as limiting thereof. The invention is defined by the following claims, with equivalents of the claims to be included therein.

That which is claimed is:

1. A system for performing chemical mechanical planarization for a semiconductor wafer comprising:

a chemical mechanical polishing (CMP) system including a chemical mechanical polishing slurry; and electrochemical potential measuring means, electrically connected to said slurry, for measuring the electrochemical potential of said slurry during chemical mechanical polishing.

2. The system according to claim 1 wherein said electrochemical potential measuring means comprises:

a reference electrode electrically connected to said slurry, said reference electrode providing a reference electrochemical potential measurement of the slurry prior to entering the system; and a measurement electrode positioned adjacent said wafer and electrically connected to said reference electrode, for measuring the electrochemical potential of the slurry during polishing relative to said reference electrochemical potential measurement.

3. The system according to claim 2 further comprising end point detection means, responsive to said electrochemical potential measuring means, for detecting an end point of said chemical mechanical polishing based upon the electrochemical potential of said slurry.

4. The system according to claim 2, wherein said measurement electrode comprises a metal layer to be polished by said CMP system on the surface of a semiconductor wafer.

5. A system according to claim 2, wherein said measurement electrode comprises a probe positioned in said chemical mechanical polishing slurry in close proximity to said semiconductor wafer.

6. A system according to claim 2, wherein said reference electrode is electrically connected to said slurry by direct contact of said electrode with said slurry.

7. A system according to claim 2, wherein said reference electrode further comprises an electrolytic conductor electrically connecting said reference electrode to said slurry.

8. A system according to claim 7, wherein said electrolytic conductor is a salt bridge.

9. A system according to claim 3, wherein said end point detection means comprises a voltmeter connecting said reference electrode and said measurement electrode, said voltmeter measuring changes in the electrochemical potential of said slurry as measured by said measurement electrode relative to the reference electrochemical potential measurement of the slurry prior to entering the system.

10. The system according to claim 1 wherein said CMP system further comprises:

a rotatable polishing platen for chemically mechanically polishing the surface of a semiconductor wafer; and a wafer support for holding a semiconductor wafer against said rotatable polishing platen.

11. The system according to claim 10, wherein said slurry is a thin continuous coating on the surface of said rotatable polishing platen.

12. The system according to claim 10, wherein said wafer support is also rotatable.

13. The system according to claim 1, wherein said chemical mechanical polishing slurry comprises abrasive particles and a chemical agent in an aqueous carrier.

14. The system according to claim 13, wherein said chemical agent is selected from the group consisting of ammonium hydroxide, ammonium nitrate, ammonium chloride, acetic acid, benzotriazole, copper(II)nitrate, ethyl alcohol, nitric acid, potassium ferricyanide, and potassium ferrocyanide.

15. The system according to claim 14, wherein said slurry comprises said chemical agent in an amount of between 1 and 5 percent by volume of said slurry.

16. A process for performing chemical mechanical planarization for a semiconductor wafer comprising:

chemically and mechanically planarizing the surface of a semiconductor wafer using a chemical mechanical polishing (CMP) system including a chemical mechanical polishing slurry; and measuring the electrochemical potential of said slurry during said planarizing step.

17. The process according to claim 16 wherein said measuring step comprises:

measuring the electrochemical potential of the slurry prior to said planarizing step to provide a reference electrochemical potential measurement; and measuring the electrochemical potential of the slurry in a region proximate the wafer during said planarizing step relative to said reference electrochemical potential measurement.

18. The process according to claim 17 further comprising controlling said planarizing step in response to said measuring step.

19. The process according to claim 17, wherein the step of measuring the electrochemical potential of the slurry in a region proximate the wafer comprises measuring the electrochemical potential of said slurry using a measurement electrode adjacent said wafer.

20. The process according to claim 19, wherein said measurement electrode comprises a metal film on the surface of the semiconductor wafer being polished by said CMP system.

21. The process according to claim 19, wherein said measurement electrode comprises a probe positioned in the slurry proximate said wafer.

22. The process according to claim 17 wherein step of measuring the electrochemical potential of the slurry prior to said planarizing step comprises measuring the electrochemical potential of the slurry using a reference electrode.

23. The process according to claim 22 wherein said reference electrode is electrically connected with the slurry during said planarizing step.

24. The process according to claim 23 wherein said reference electrode is electrically connected with the slurry by directly contacting said reference electrode with said slurry.

25. The process according to claim 23 wherein said reference electrode is electrically connected with the slurry through an electrolytic conductor.

26. The process according to claim 18 wherein said controlling step comprises detecting an end point to said planarizing step based upon a change in the measured electrochemical potential of the slurry in a region proximate the wafer relative to a reference electrochemical potential measurement.

27. The process according to claim 17 further comprising the step of controlling said planarizing step in response to the step of measuring the electrochemical potential of the slurry during planarizing based upon a change in the measured electrochemical potential of the slurry in a region proximate the wafer relative to said reference electrochemical potential measurement.

* * * * *